US011624552B2

(12) United States Patent
Basarir et al.

(10) Patent No.: US 11,624,552 B2
(45) Date of Patent: Apr. 11, 2023

(54) COOLING DEVICE HAVING AN IMPROVED SEALING ASSEMBLY

(71) Applicant: BSH Hausgeraete GmbH, Munich (DE)

(72) Inventors: Veli Basarir, Tekirdag (TR); Necati Bora Guerel, Tekirdag (TR); Dogan Kilinc, Istanbul (TR); Seyhun Oezkayran, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 212 days.

(21) Appl. No.: 17/115,371

(22) Filed: Dec. 8, 2020

(65) Prior Publication Data

US 2021/0172674 A1 Jun. 10, 2021

(30) Foreign Application Priority Data

Dec. 10, 2019 (TR) ..... 2019/19690

(51) Int. Cl.
*F25D 23/08* (2006.01)
*E05C 19/16* (2006.01)

(52) U.S. Cl.
CPC ..... *F25D 23/087* (2013.01); *E05C 19/161* (2013.01); *F25D 2323/02* (2013.01); *F25D 2400/06* (2013.01)

(58) Field of Classification Search
CPC .... F25D 23/087; F25D 23/082; F25D 23/085; F25D 2323/02; F25D 2400/06; E05C 19/161
See application file for complete search history.

(56) References Cited

U.S. PATENT DOCUMENTS

| | | | | |
|---|---|---|---|---|
| 6,036,294 | A * | 3/2000 | Banicevic | F25D 23/069 312/407 |
| 6,428,130 | B1 * | 8/2002 | Banicevic | F25D 21/04 312/407 |
| 6,464,312 | B1 * | 10/2002 | Tenhundfeld | E05C 19/161 49/478.1 |
| 9,885,202 | B2 * | 2/2018 | Laible | E05C 19/161 |
| 10,563,905 | B1 * | 2/2020 | Allard | F25D 23/028 |
| 2018/0259244 | A1 * | 9/2018 | Kim | F25D 23/087 |
| 2020/0011590 | A1 * | 1/2020 | Johnson | E06B 7/2309 |
| 2021/0404731 | A1 * | 12/2021 | Caglin | F25D 23/028 |

FOREIGN PATENT DOCUMENTS

| | | | | |
|---|---|---|---|---|
| EP | 2557380 | A2 * | 2/2013 | F25D 21/04 |
| WO | WO-2006120106 | A1 * | 11/2006 | E05C 19/161 |
| WO | WO-2008020670 | A1 * | 2/2008 | F25D 23/087 |
| WO | WO-2018164590 | A1 * | 9/2018 | E05C 19/161 |

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

A cooling device includes a cabinet body that encloses a compartment, a door operatively associated with the cabinet body to selectively enclose the compartment, a heat source to heat transfer, a first magnetic element in contact with or attached to a front flange of the cabinet body and a sealing assembly for sealing an area between the cabinet body and the door of the cooling device. The heat source and the first magnetic member are at least partly in contact with each other in such a way that condensation problems thereof are effectively reduced.

14 Claims, 5 Drawing Sheets

COOLING DEVICE HAVING AN IMPROVED SEALING ASSEMBLY

CROSS-REFERENCE TO RELATED APPLICATION

This application claims the priority, under 35 U.S.C. § 119, of Turkish Patent Application TR 2019/19690, filed Dec. 10, 2019; the prior application is herewith incorporated by reference in its entirety.

BACKGROUND OF THE INVENTION

Field of the Invention

The present invention relates to a heating configuration for a cooling device. More particularly, the invention relates to a sealing assembly for a door of the cooling device and a magnetic element configuration in a front flange of the cooling device for minimizing condensation problems.

Cooling devices are one of the most frequently used electrical devices. Such cooling devices are needed for keeping food fresh for a predetermined period by reducing the temperature of a cooling compartment and a freezing compartment. The access to any food compartment of the cooling device may be realized by opening a door which is rotatably mounted in a cabinet body.

A gasket provided as a sealing assembly in cooling devices can be used as a mechanical seal which fills a space between two or more mating surfaces, generally to prevent leakage. It is well known that cooling devices are constructed in such a manner that the outer surfaces of the compartment along the sealed edges of the doors are cooled to a temperature below the dew point of the surrounding air. That causes the moisture in the air to condense along the exterior edge of the door or along the front flange of the cooling device.

In the prior art, sealing assembly structures are used with heat sources in the form of a tube which forms part of the refrigeration cycle. Especially under high temperature and humidity conditions, condensation may form on the outer surface of the sealing assembly relative to the low temperature in the cooling compartments. It is known that the heat source is provided in the front flange of the cabinet body so as to minimize any such condensation of moisture due to any temperature difference between the compartments and the outside air.

A prior art publication in the technical field of the present invention, which may be referred to among others, is U.S. Pat. No. 6,464,312 B1, which discloses thermal breakers and door seal configurations for refrigerators.

Despite the use of heat sources in cooling devices, condensation may still occur on a flat outer wall of the front flange. Furthermore, the assembly process of the heat source needs to be simplified. Thus, there is a need for an improved heater performance with more efficient construction.

BRIEF SUMMARY OF THE INVENTION

It is accordingly an object of the invention to provide a cooling device having an improved sealing assembly, which overcomes the hereinafore-mentioned disadvantages of the heretofore-known devices of this general type.

With the foregoing and other objects in view there is provided, in accordance with the invention, a cooling device, comprising a cabinet body that encloses a compartment, a door operatively associated with the cabinet body to selectively enclose the compartment, a heat source to transfer heat, a first magnetic element in contact with or attached to a front flange of the cabinet body, a sealing assembly for sealing the area between the cabinet body and the door of the cooling device, and the heat source and the first magnetic member are at least partly in contact with each other in such a way that condensation problems thereof are effectively reduced.

As a consequence, the temperature is increased due to heat transfer from the heat source to the magnetic member, thereby minimizing the temperature difference between the inner and outer surfaces of the sealing assembly and eliminating the condensation problem at the outer surface of the sealing assembly at the same time. Thus, thanks to the accumulation of heat on the first magnetic element, the average temperature will increase on the sealing assembly and condensation problems will be minimized. Bending and protrusions that are needed when assembling the heat source in the prior art is eliminated and misalignment of the heat source is effectively minimized. Production and the assembly of the heat source is simplified.

In a possible embodiment, the cooling device can be at least one of a refrigerator, a freezer, a refrigerator-freezer combination device and a wine cabinet.

In a possible embodiment, the sealing assembly includes a plurality of air chambers for insulation. The sealing assembly includes an attachment portion being adapted for attaching the sealing assembly to the door.

In a possible embodiment, the front flange has a planar outer wall that is disposed to be in touch with the sealing assembly and an inner wall onto which the first magnetic element is provided. Thus, thermal efficiency is increased.

In a possible embodiment, the first magnetic element has a first planar surface that is disposed to be in contact with the inner wall of the front flange and a second planar surface opposite to the first planar surface, wherein the heat source is placed on the second planar surface. This increases the contact area and provides a quick heat transfer to the target area efficiently, thereby preventing condensate formation on an outer wall of the front flange.

In a possible embodiment, the sealing assembly has a contact wall facing the front flange and is disposed to be in contact at least partly with the front flange. This configuration increases thermal efficiency and helps to maintain the components strictly together.

In a possible embodiment, the first magnetic element is bonded to the front flange by a first adhesive tape. This results in enhanced heating of the sealing assembly in an effective manner and eliminates water formation on the outer surface of the sealing assembly.

In a possible embodiment, the first adhesive tape is a metallic foil tape with pressure sensitive adhesives and is disposed to completely cover the first magnetic element. Thus, a durable and solid attachment is provided with proper heat dissipation.

In a possible embodiment, the first adhesive tape is extended over at least one of the lateral walls of the front flange.

In a possible embodiment, the sealing assembly includes deformable outer side walls extending between the contact wall and the attachment portion. Elastically deformable outer side walls improve the flexibility of the sealing assembly. A prolonged life expectancy of the seal assembly is provided by virtue of the elastically deformable outer side walls.

In a possible embodiment, the sealing assembly includes a second magnetic element that is fixedly secured to the magnetic element housing of the sealing assembly so as to be in the proximity of the first magnetic element.

In a possible embodiment, the heat source is a tube that is made of metal, preferably copper and is disposed to carry condenser fluid between components of a cooling system of the cooling device. Thus, condenser fluid of the system is used for condensation problems on the sealing assembly and the front flange with an increased efficiency.

In a possible embodiment, the cooling device includes a second adhesive tape that is disposed, at least partly, to cover the heat source, the first magnetic element and the front flange for adhesively bonding. This helps to retain the heat source on the magnetic element by eliminating an extra process.

In a possible embodiment, the second adhesive tape is extended along or over at least one of the lateral walls of the front flange. Thus, strong bonding is achieved.

In a possible embodiment, the second adhesive tape is a pressure-sensitive adhesive having a first planar surface and a second planar surface with an adhesive. This helps to simplify the assembly process.

Other features which are considered as characteristic for the invention are set forth in the appended claims.

Although the invention is illustrated and described herein as embodied in a cooling device having an improved sealing assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
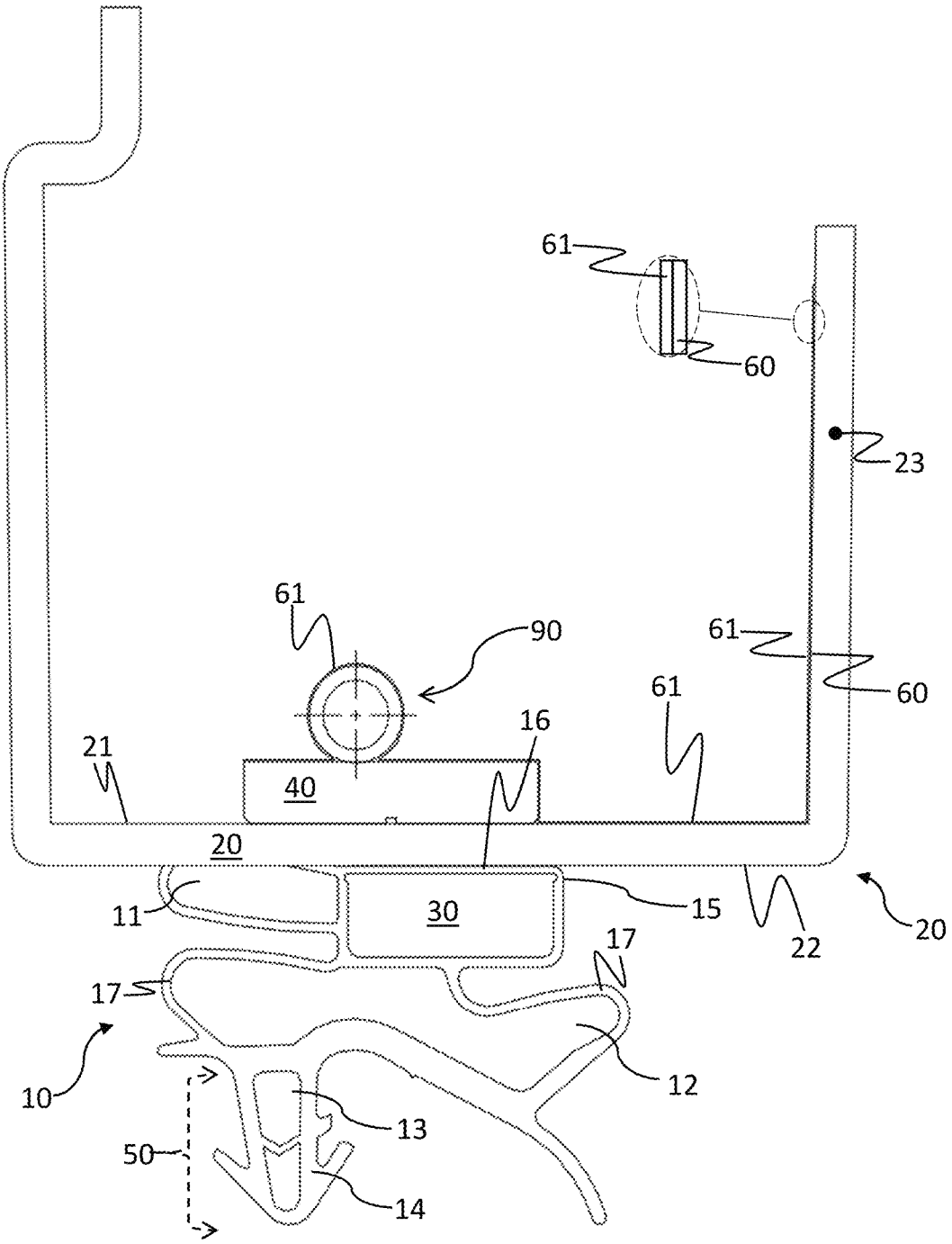
FIG. 1 is a diagrammatic, top-plan view of the sealing assembly in a cooling device, wherein an adhesive tape is applied to a heat source, a first magnetic member and a front flange according to the present invention.
Figure 5:
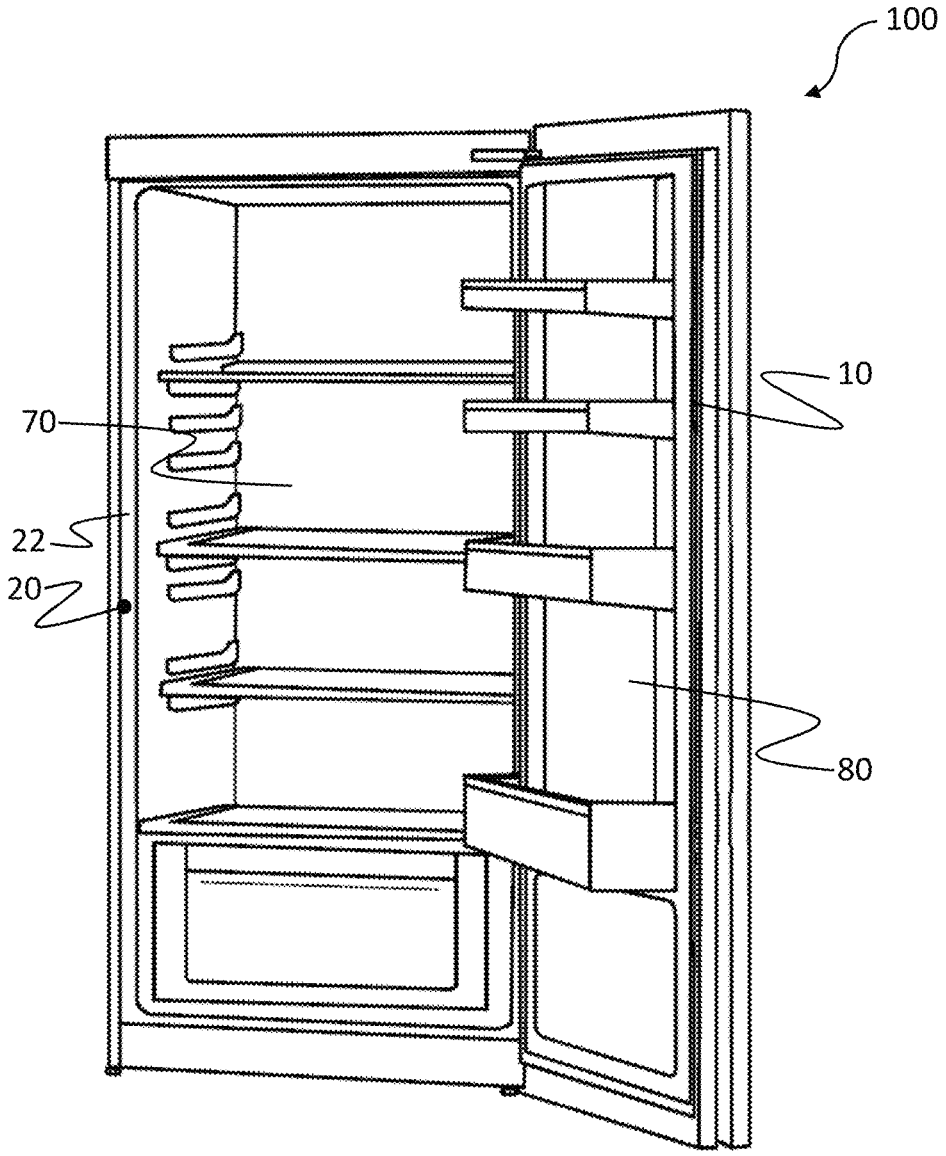
FIG. 5 is a perspective view of the cooling device according to the present invention.

Referring now in detail to the figures of the drawings and first, particularly, to FIGS. 1 and 5 thereof, it is seen that the present invention proposes a cooling device 100 including a cabinet body 70 that encloses a compartment, a door 80 operatively associated with the cabinet body 70 to selectively enclose the compartment, a heat source 90 for transferring heat, a first magnetic element 40 in contact with or attached to a front flange 20 of the cabinet body 70, and a sealing assembly 10 for sealing an area between the cabinet body 70 and the door 80 of the cooling device 100, wherein the sealing assembly 10 includes a plurality of air chambers 11, 12 for insulation and an attachment portion 50 being adapted for attaching the sealing assembly 10 to the door 80. According to the present invention the heat source 90 and first magnetic member 40 are disposed to be at least partly in contact with each other in such a way that condensation problem thereof is effectively reduced.

According to the present invention, the sealing assembly 10 is disposed to surround an entire periphery of the interior surface of the door 80, and is formed of rubber or other suitable elastomeric material that defines a number of collapsible air spaces 11, 12, and includes deformable outer side walls 17 extending between a planar contact wall 16 and the attachment portion 50.

With the door 80 in the closed position the sealing assembly 10 is applied against the front flange 20 forming the front side of the cabinet body 70. This front flange 20 has a substantially flat outer wall 22 that is contacted and sealed against when the door 80 is closed against the cabinet body 70. Referring to FIG. 1, it is seen that a second magnetic element 30 is encased within a magnetic member housing 15 and has a quadrangular cross-section. The front flange 20 of the cabinet body 70 typically extends all the way around the openings of the compartments of the cooling device 100. This front flange 20 is primarily formed of insulative materials to prevent or slow the transmission of heat. Foam insulation can be disposed behind the front flange 20 and the front flange 20 can be formed of plastic or other non-magnetic material having suitable resistance to heat conductivity.

Figure 2:
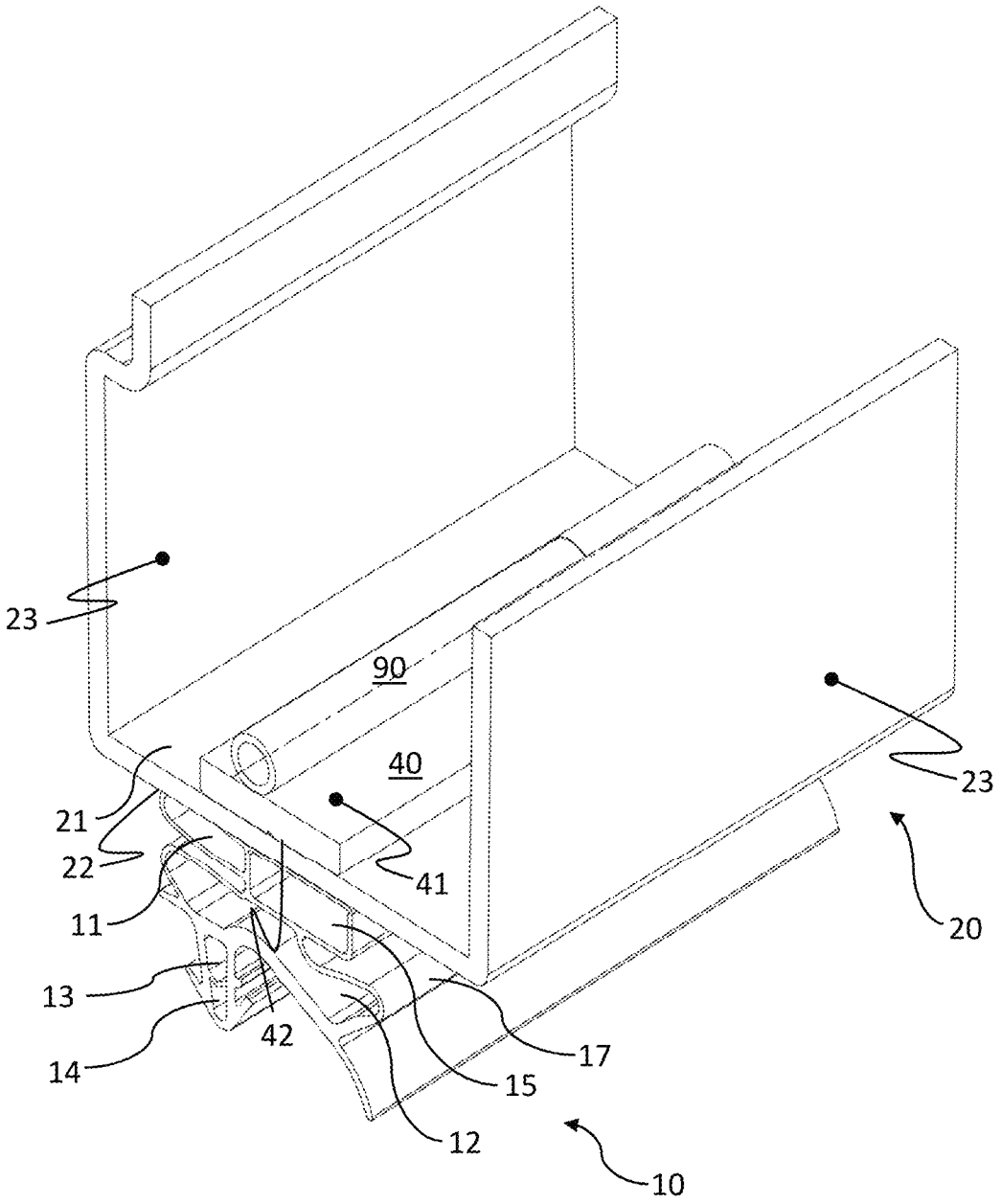
FIG. 2 is a perspective view of the sealing assembly in the cooling device according to the present invention.
Figure 3:
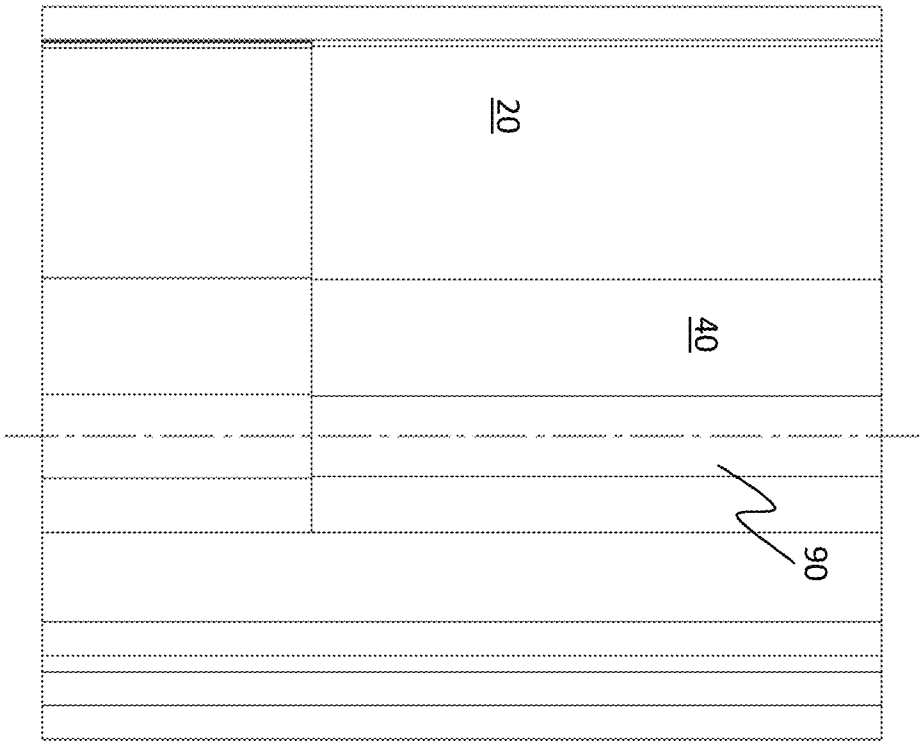
FIG. 3 is a top-plan view of the sealing assembly in the cooling device shown in FIG. 2.

As shown in FIGS. 1-3, the heat source 90 can be placed longitudinally on the first magnetic element 40 and can be an electric heating element, that is, a heating tube, a heating wire, or it can also be a heating pipe, in which any type of hot fluid can pass through the heat source 90. This direct contact of the heat source 90 to the first magnetic element 40 warms the outer wall 22 of the front flange 20 of the cabinet body 70 to reduce or eliminate sweating of the outer wall 22.

The second magnetic member 30 extends at least partly along the sealing assembly 10. The magnetic force ensures that a contact wall 16 of the sealing assembly 10 is brought into close contact with the outer wall 22 of the front flange 20 of the cabinet body 70 and the door 80, thus providing a further reinforcement of the sealing. The first and second magnetic members 40, 30 can be made of any material which can be confined by the magnetic force, that is, the material of a ferromagnetic member magnetizable by the magnetic force. The first and second magnetic elements 40, 30 are dual pole magnets. The second magnetic member 30 is shaped and dimensioned with respect to the cross-section of the magnetic member housing 15.

The heat source 90 is a tube that is made of metal, preferably copper and is disposed to carry condenser fluid between components of the cooling system of the cooling device 100. This heat source 90 is disposed to circulate heated condenser fluid from the cooling mechanism along the front flange 20, thereby helping to keep the front flange 20 above the ambient air dew point and reducing or eliminating water formation on the front flange 20 and the sealing assembly 10.

Figure 4:
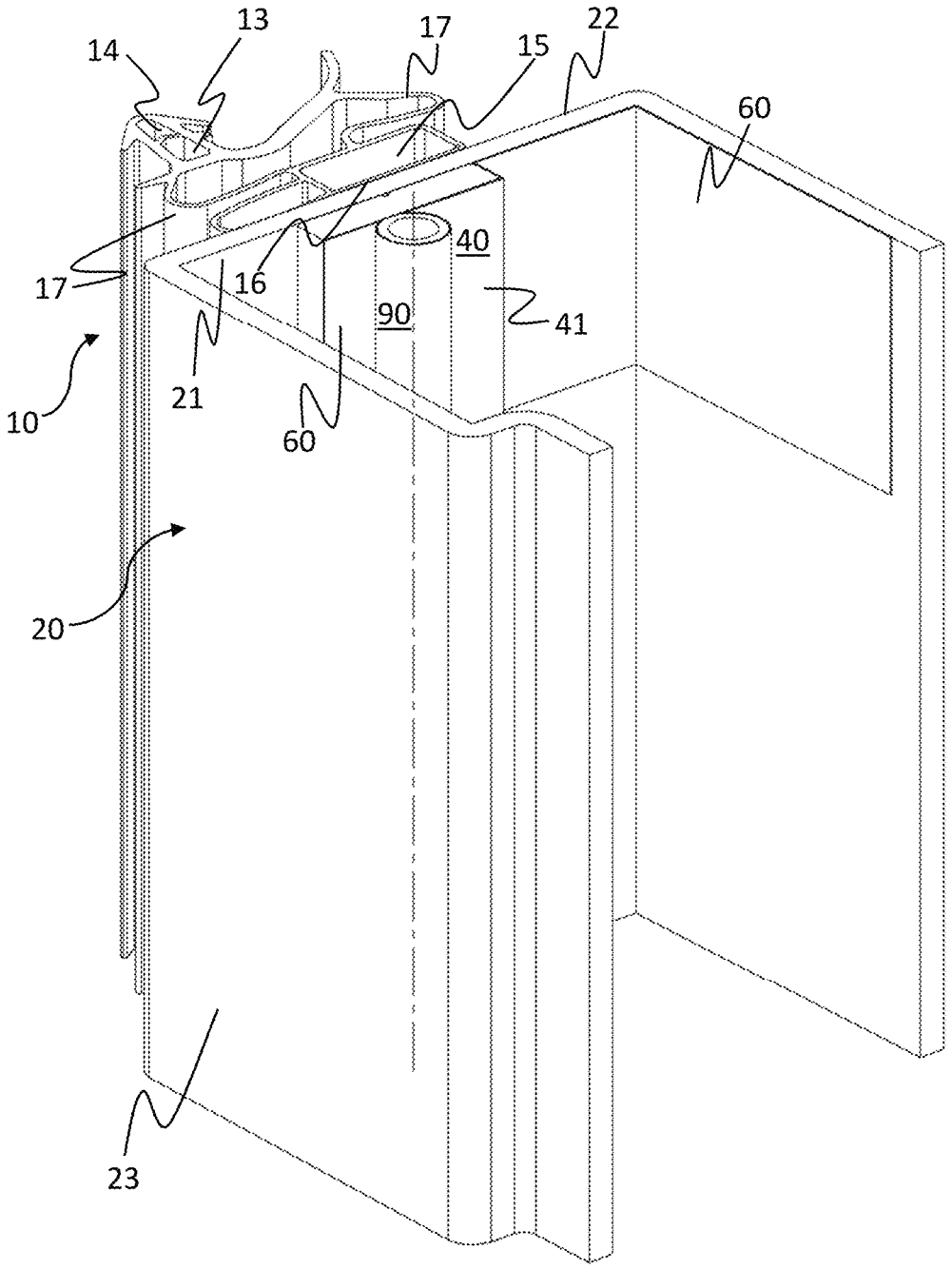
FIG. 4 is another perspective view of the sealing assembly in the cooling device according to the present invention.

Referring to FIG. 2, it is seen that the first magnetic element 40 has a first planar surface 42 that is disposed to be in contact with the inner wall 21 of the front flange 20, and a second planar surface 41 opposite the first planar surface 42. The heat source 90 is placed on the second planar surface 41. In a possible embodiment, before the placement of the heat source 90, the first magnetic element 40 is adhered onto the inner wall 21 by using a first adhesive tape 60 as shown in FIG. 4. This first adhesive tape 60 can be a metallic foil tape, preferably aluminum, with pressure sensitive adhesives and can be disposed to completely cover the first magnetic element 40. With this configuration, misalignment of the first magnetic element 40 is eliminated and thermal efficiency is increased by spreading the heat properly by using the first adhesive tape 60.

According to the present invention, the heat source 90, preferably as a tube, is attached to the second planar surface 41 of the first magnetic element 40 by a second adhesive tape 61 as shown in FIG. 1. The second adhesive tape 61 has a sufficient bonding strength that will enable the heat source 90 to retain its desired position until insulation foam is deployed, at which time the rigidity of the cured foam will easily nullify the repulsion forces. The second adhesive tape 61 can be a transparent polyurethane adhesive tape that resists punctures, tearing and abrasion, and resists ultraviolet light.

In the art, the heat source 90 is placed in the proximity of the first magnetic element 40 with an internal gap. That assembly method increases the condensation on the front flange 20 and leaves a mold mark on the front flange 20 if the heat source 90 is not aligned properly. By eliminating that problem and increasing thermal efficiency as well, the heat source 90 is placed on the first magnetic element 40 after the first magnetic element 40 is covered by the first adhesive rape 60. In a first step, the first magnetic element 40 is placed on the inner wall 21 of the front flange 20 and then adhered at least partly by the first adhesive tape 60. In a second step, the heat source 90 is placed onto the covered first magnetic element 40 and adhered by the second adhesive tape 61. The second adhesive tape 61 covers almost all of the second planar surface 41 of the first magnetic element 40 and extends to the inner wall 21 of the front flange 20. The first and second adhesive tapes 60, 61 are, preferably, extended at least to one of the lateral walls 23 of the front flange 20 and are positioned substantially above each other. The lateral walls 23 form a U-shaped front flange 20.

In a possible embodiment, the first and second adhesive tapes 60, 61 are pressure-sensitive adhesives having a first planar surface and a second planar surface with an adhesive. This type of pressure-sensitive adhesives may include an elastic component modified through the addition of a viscous or plastic component.

Again referring to FIG. 1, the sealing assembly 10 is provided with the attachment portion 50. The attachment portion 50 is inserted into a mounting groove formed along the door 80 and provides the fixation of the sealing assembly 10 to the door 80 of the cooling device 100. The attachment portion 50 includes an end portion 14 which has an arched shaped profile and includes at least one set of catching wings extending outwardly from the attachment portion 50. The catching wings are formed on both ends of the attachment portion 50, so that the attachment portion 50 is inserted into a mounting groove of the door 80 and does not come out inadvertently, thereby providing a tight fixation between the door 80 of the cooling device 100 and the sealing assembly 10 when in use. The attachment portion 30 further includes at least one opening 13 as a hollow space.

The cooling device 100 can be a refrigerator, which includes a cabinet body 70 and door(s) 80 which can be secured by hinged attachment to the cabinet body 70 so that the door 80 will open away from the cabinet body 70 while pivoting upon the hinged attachments. Furthermore, the cooling device can be a freezer, a refrigerator-freezer combination device or a wine cabinet. In a possible embodiment, the first magnetic element 40 and the second magnetic element 30 are preferably dual pole magnets having either north or south poles at each of its latitudinal ends with a central portion of the element having the opposite polarity.

REFERENCE NUMBERS

10. Sealing assembly
11. Air chamber
12. Air chamber
13. Opening
14. End portion
15. Magnetic member housing
16. Contact wall
17. Outer side wall
20. Front flange
21. Inner wall
22. Outer wall
23. Lateral wall
30. Second magnetic member
40. First magnetic member
41. Second planar surface
42. First planar surface
50. Attachment portion
60. First adhesive tape
61. Second adhesive tape
70. Cabinet body
80. Door
90. Heat source
100. Cooling device

The invention claimed is:

1. A cooling device, comprising:
a cabinet body enclosing a compartment, said cabinet body having a front flange;
a door operatively associated with said cabinet body for opening and closing said compartment;
a heat source for transferring heat;
a first magnetic element in contact with or attached to said front flange;
a sealing assembly for sealing an area between said cabinet body and said door;
said heat source and said first magnetic member being at least partly in contact with each other;
said front flange having a planar outer wall in contact with said sealing assembly and an inner wall, said first magnetic element being disposed on said inner wall;
said first magnetic element having first and second mutually opposite planar surfaces, said first planar surface being in contact with said inner wall of said front flange, and said heat source being disposed on said second planar surface; and
said heat source not being in direct contact with said front flange.

2. The cooling device according to claim 1, wherein said sealing assembly has a contact wall facing and at least partly contacting said front flange.

3. The cooling device according to claim 1, which further comprises a first adhesive tape bonding said first magnetic element to said front flange.

4. The cooling device according to claim 3, wherein said first adhesive tape is a metallic foil tape with pressure sensitive adhesives.

5. The cooling device according to claim 3, wherein said first adhesive tape completely covers said first magnetic element.

6. The cooling device according to claim 3, wherein said front flange has lateral walls, and said first adhesive tape extends along at least one of said lateral walls.

7. The cooling device according to claim 1, wherein said sealing assembly includes a magnetic element housing, and said sealing assembly includes a second magnetic element fixedly secured to said magnetic element housing in proximity of said first magnetic element.

8. The cooling device according to claim 1, wherein said heat source is a metal tube.

9. The cooling device according to claim 8, wherein said heat source is configured to carry condenser fluid between components of a cooling system of the cooling device.

10. The cooling device according to claim 1, wherein said heat source is a copper tube.

11. The cooling device according to claim 1, wherein the cooling device is at least one of a refrigerator, a freezer, a combined refrigerator-freezer or a wine cabinet.

12. A cooling device, comprising:

a cabinet body enclosing a compartment, said cabinet body having a front flange;

a door operatively associated with said cabinet body for opening and closing said compartment;

a heat source for transferring heat;

a magnetic element in contact with or attached to said front flange;

a sealing assembly for sealing an area between said cabinet body and said door;

said heat source and said magnetic member being at least partly in contact with each other;

a first adhesive tape bonding said magnetic element to said front flange; and a second adhesive tape at least partly covering said heat source, said magnetic element and said front flange for adhesively bonding.

13. The cooling device according to claim 12, wherein said front flange has lateral walls, and said second adhesive tape extends along at least one of said lateral walls.

14. The cooling device according to claim 12, wherein said second adhesive tape is a pressure-sensitive adhesive tape having a first planar surface and a second planar surface with an adhesive.

* * * * *